US006850194B2

(12) United States Patent
Fukushima et al.

(10) Patent No.: US 6,850,194 B2
(45) Date of Patent: Feb. 1, 2005

(54) ANTENNA UNIT

(75) Inventors: Susumu Fukushima, Osaka (JP); Masahiro Yoshii, Gifu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/475,351

(22) PCT Filed: Nov. 18, 2002

(86) PCT No.: PCT/JP02/12004

§ 371 (c)(1),
(2), (4) Date: Oct. 20, 2003

(87) PCT Pub. No.: WO03/058757

PCT Pub. Date: Jul. 17, 2003

(65) Prior Publication Data

US 2004/0125022 A1 Jul. 1, 2004

(30) Foreign Application Priority Data

Dec. 28, 2001 (JP) ..... 2001-400136

(51) Int. Cl.[7] ..... H01Q 1/38
(52) U.S. Cl. ..... 343/700 MS; 343/702
(58) Field of Search ..... 343/700 MS, 702, 343/846, 848

(56) References Cited

U.S. PATENT DOCUMENTS 5,471,221 A 11/1995 Nalbandian et al. . 343/700 MS
5,798,734 A * 8/1998 Ohtsuka et al. ..... 343/700 MS
6,018,319 A * 1/2000 Lindmark ..... 343/700 MS
6,018,320 A * 1/2000 Jidhage et al. ..... 343/700 MS
6,054,953 A * 4/2000 Lindmark ..... 343/700 MS

FOREIGN PATENT DOCUMENTS

| | | |
|---|---|---|
| JP | 63-155919 | 6/1988 |
| JP | 7-50516 | 2/1995 |
| JP | 11-168316 | 6/1999 |
| JP | 11-261456 | 9/1999 |

* cited by examiner

*Primary Examiner*—Tan Ho
(74) *Attorney, Agent, or Firm*—Wenderoth, Lind & Ponack L.L.P.

(57) ABSTRACT

In an antenna unit used for a radio communication device in mobile communications, the object of the present invention is to provide an easily portable antenna unit with low profile but high gain. Furthermore, the structure of the antenna unit can offer easy impedance-matching and maintain a preferable shape for the long term. In the antenna unit of the present invention, an opening is disposed in a part of a conductive material-made ground section made of conductive material. An antenna plate made of conductive material is disposed at the upper surface of the opening, while a ground plate made of conductive material is disposed at the upper section on the rear side of the opening. In addition, a radio frequency circuit is mounted on an area in a ground section other than the opening.

19 Claims, 8 Drawing Sheets

ANTENNA UNIT

TECHNICAL FIELD

The present invention relates to an antenna unit employed in communication equipment, including small mobile devices and a card-type terminal for a keyless entry system, and such communication equipment using the antenna unit.

BACKGROUND ART

FIG. 9 shows a prior-art small compact antenna (disclosed in Japanese Patent Examined Publication No. H6-93635), which has been employed in mobile communication equipment including a pager. Metal plate 101 serves as a ground plane that is an element of a micro-strip antenna. On metal plate 101, printed circuit board 105 having a circuit for wireless communication thereon is formed. Conductor plate 102 is disposed on plate 101 via dielectric 104. The width of conductor plate 102 is narrower than the width of metal plate 101. Metal plate 101 and conductor plate 102 are oppositely disposed. Dielectric 104 is sandwiched between plates 101 and 102.

Printed circuit board 105 is disposed on a section of plate 101 which conductor plate 102 does not face. Plates 101 and 102 each mechanically and electrically connect, at one end, with joint plate 103. The structure of square U-shaped plates 101, 102, and 103 forms a micro-strip antenna. The other ends of plates 101 and 102 are grounded via capacitor 106 so as to synchronize with a desirable frequency of the antenna. At the same time, impedance-matching has been optimized by determining an effective location of feeder section 107.

However, such a micro-strip antenna has an antenna gain generally lower than that of a dipole antenna. For achieving higher antenna gain, it is necessary to keep the distance between conductive plate 102 and metal plate 101 as large as possible. In addition, to respond to the demand for obtaining a more compact antenna, the circuit-mounted area should be reduced to nearly half. That is, the radio frequency circuits should also be disposed on the lower surface of metal plate 101, as well as on the upper surface of the metal plate. As another inconvenience, forming the micro-strip antenna of a conductive plate has been an obstacle to achieving a metalworking and implementation with high dimensional accuracy in high volume production.

SUMMARY OF THE INVENTION

The present invention addresses the problems discussed above. It is therefore the object to provide an antenna unit not only having a lower profile and higher gain, but also having a structure adaptable for mass production.

To achieve this object, in the structure of the antenna unit of the present invention, an opening is disposed in a part of the ground section made of a conductor, and an electrically conductive antenna plate is disposed on the upper section of the front surface of the opening. Furthermore, an electrically conductive ground plate is disposed on the upper section of the rear surface of the opening, and the radio frequency circuit or the like is disposed on a part—where the opening is not disposed—of the ground section.

DETAILED DESCRIPTION OF THE INVENTION

Hereinafter, the antenna unit of the present invention is described in the embodiments below.

First Exemplary Embodiment

Figure 1A:
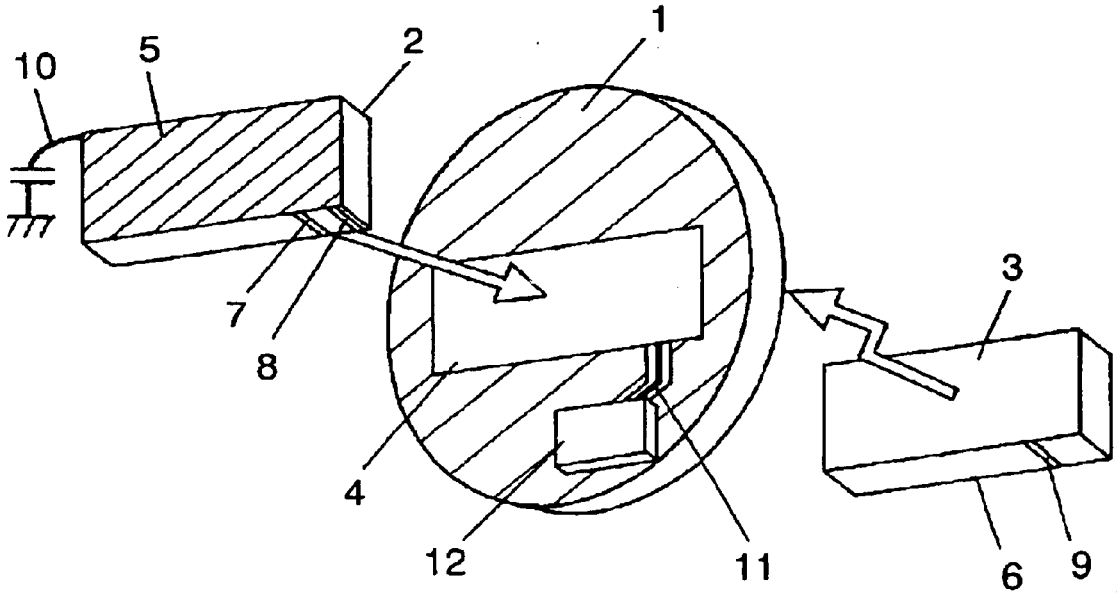
FIG. 1A is an exploded perspective view of the antenna unit of a first embodiment.
Figure 1B:
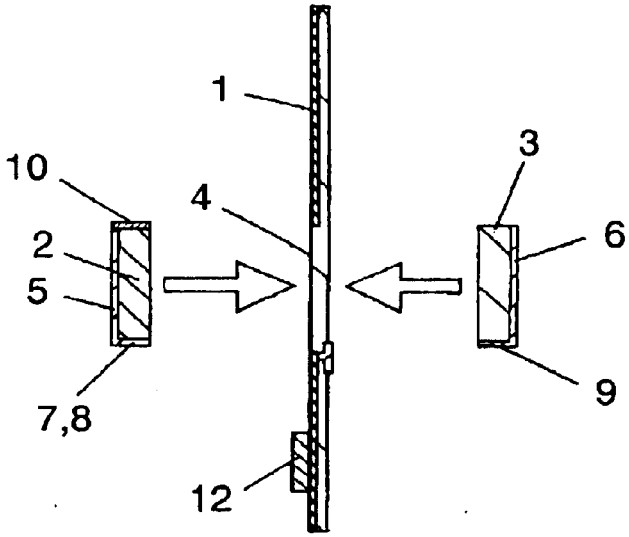
FIG. 1B is an exploded sectional view of the antenna unit of the first embodiment.

The structure of the antenna unit of the first embodiment of the present invention is described hereinafter with reference to the accompanying drawings, FIG. 1A and FIG. 1B.

Ground layer 1 is formed of conductive material on the surface of first substrate 100. Ground layer 1 has opening 4 at a part of its surface, so that ground layer 1 provides no conductivity at this part. Second substrate 2 is formed of insulating resin over one side of opening 4 on substrate 100. Third substrate 3, which is also made of insulating resin, is disposed opposite to the second substrate 2 through first substrate 100. On the surface of second substrate 2, first conductor layer 5 is disposed so as to serve as an antenna plate. On the other hand, on the surface of third substrate 3, second conductor layer 6 is disposed so as to serve as a part of a ground plate. First feeder section 7 and first short-circuit section 8 are formed on second substrate 2. One end of it feeder section 7 is connected to conductor layer 5, while one end of first short-circuit section 8 is also connected to conductor layer 5, and the other end is connected to ground layer 1. Second substrate 2 couples capacitor 0, located nearly diagonal to feeder section 7, to both first conductor layer 5 and ground layer 1. Second short-circuit section 9 is disposed on third substrate 3. One end of second short-circuit section 9 is connected to second conductor layer 6, and the other end is connected to ground layer 1 via ground short-circuit through-hole (via) 16 in first substrate 100. Via 16 is formed by machining processes, such as punching and drilling, and then the machined through-hole is filled with conductive material. The conductive material in the through-hole is electrically insulated from ground layer 1 on first substrate 100. For each substrate above, a commercially available circuit board given patterning and necessary treatment can be employed. As for each conductive layer, foil typified by copper foil or a deposited metal layer can be employed. The short-circuit section and the feeder section are formed of a material such as conductive paste or metallic powder. Each conductor layer and the short-circuit section, or each conductor layer and the feeder section is soldered to connect each other. A joint formed of electrically conductive paste can be an alternative to the soldered joint.

As an advantage of the antenna unit of the invention, employing third substrate 3 increases the distance from conductor layer 5 (serving as the antenna plate) to second conductor layer 6 (serving as the ground plate). The increased distance between the antenna plate and the ground plate can offer higher radiant gain and broader bandwidth.

In the structure above, first feeder section 7 is situated at a position generally having a high electric-field strength between first and second conductor layers. As another advantage, loading capacitance to a position diagonal to feeder section 7 allows the capacitance loaded to get lowered so that loss of load capacity can be minimized.

Metal plates, which have been conventionally used for the material of an antenna, are hard to machine and do not maintain the shape of the antenna well. In the present invention, however, the substrates used for the antenna are made of electrically-insulating resin, which contributes to an easy machining and constantly-maintained antenna shape. In addition, impedance matching of the antenna can be performed by changing relative permittivity, tanδ, of the insulating resin-made substrate used for the antenna.

The substrates used for second substrate 2 and third substrate 3 are not required to have the same tanδ and the same relative permittivity. For matching impedance of the antenna unit, a plurality of third substrates 3, each of which has a differently positioned second short-circuit section 9, should preferably be prepared in advance. Attaching each substrate individually on opening 4 can facilitate an easy and quick impedance-matching. As another plus, changing the position of second short-circuit 9 can also vary the radiation pattern of the antenna unit. Therefore, the optimum radiation pattern with respect to the wave conditions for the location of the antenna unit can be easily selected.

Figure 2:
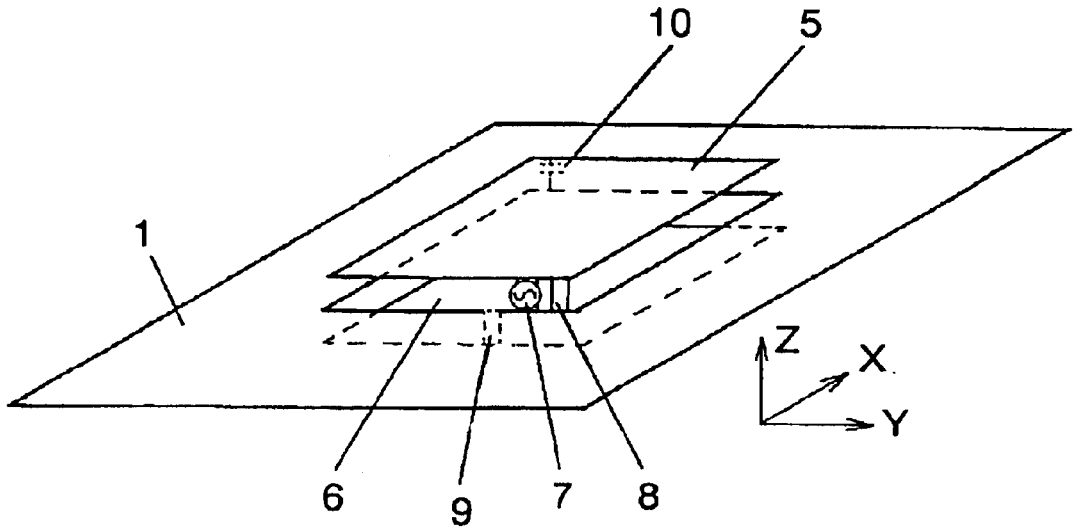
FIG. 2 is a perspective view of an antenna model that is used for illustrating the technical advantages obtained from the antenna unit of the first embodiment.

FIG. 2 shows the antenna model used for showing characteristics of impedance and the radiation pattern that vary as the position of second short-circuit section 9 of the antenna unit changes. In the model, first conductor layer 5 and second conductor layer 6 have a size of 30 mm by 30 mm, and first feeder section 7, first short-circuit section 8, and second short-circuit section 9 are each 2 mm long.

Ground layer 1 with a size of 80 $mm^2$ has opening 4 of 30 $mm^2$ in its center. The second and the third substrates are fixed so as to sandwich opening 4 of first substrate 100 therebetween. As a result, first conductor layer 5 and second conductor layer 6 are oppositely arranged via first substrate 100 in the vertical direction in FIG. 2. In the antenna model, the position of second short-circuit section 9 was varied as follows:

Position in case (a): just under first short-circuit section 8;

Position in case (b): just under first feeder section 7; and

Position in case (c): just under the position 1 mm-away from first feeder section 7 in the opposite direction to first short-circuit section 8.

Figure 3:
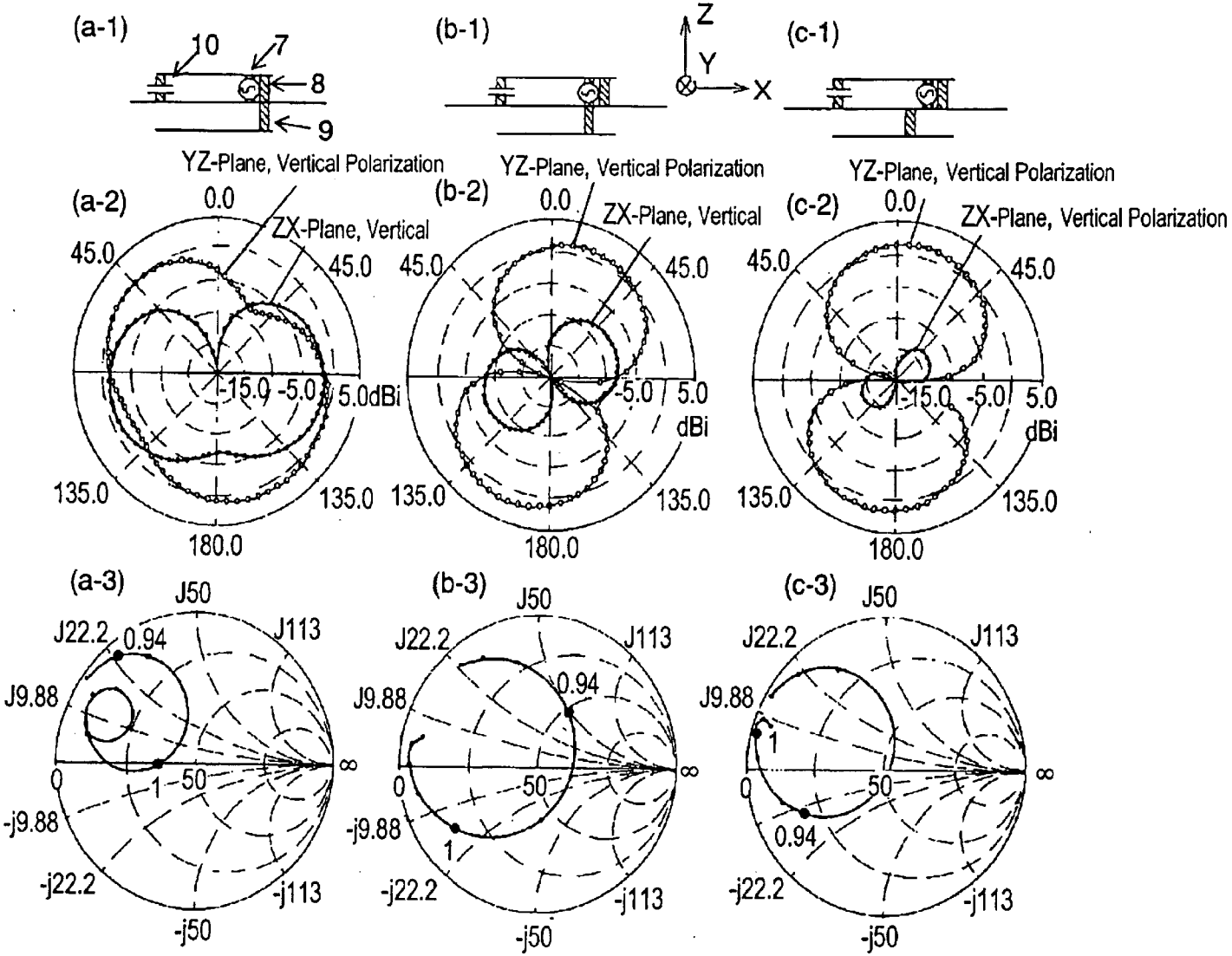
FIG. 3 is a plot showing antenna characteristics that vary with the location of a second short-circuit section in the antenna unit of the first embodiment.

FIG. 3 shows the position-to-position measurement results of changes in characteristics of impedance and radiation pattern.

In the impedance characteristics, a circular path on Smith Chart changes its size from (a-3) through (b-3) to (c-3) as the position of second short-circuit section 9 varies from case (a) through (b) to (c). Accordingly, there are significant differences in resonance frequency corresponding to each case. On the other hand, in the radiation characteristics, it will be noted that case (a) offers a high antenna gain along the X-axis or the Y-axis, while case (c) offers a high antenna gain along the Z-axis. That is, the antenna gain can be easily controlled by changing the position of second short-circuit section 9.

Although the first embodiment demonstrates that the characteristics of impedance and radiation pattern can be controlled by the structure in which a single short-circuit section is disposed, it is not limited thereto. The same effect can be obtained by the structure having a plurality of short-circuit sections.

Figure 4:
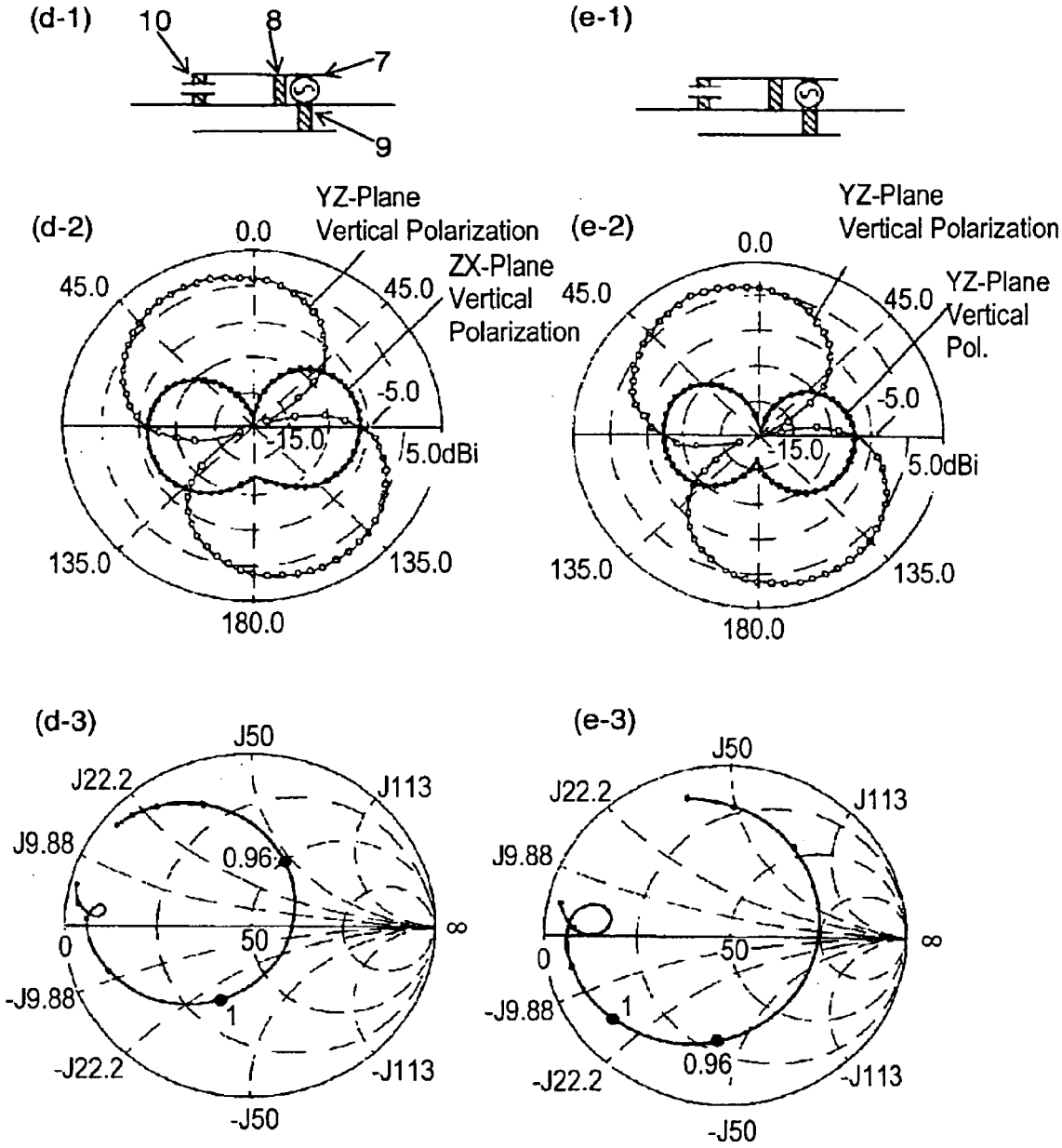
FIG. 4 is a plot showing antenna characteristics that vary with the location of a first short-circuit section in the antenna unit of the first embodiment.

FIG. 4 shows the changes in the characteristics of impedance and the radiation pattern when the position of first short-circuit section 8 moves from position (d) to position (e), in which each position is as follows:

Position in case (d): the position 1 mm-away from first feeder section 7; and Position in case (e): the position 2 mm-away from first feeder section 7.

Although a significant difference between the positions above is not observed, the size of the circular path on Smith Chart can be changed. It will also be noted that resonance frequency can be controlled.

In other words, locating the short-circuit section 8 close to first feeder section 7 allows the antenna unit to have an optimal condition without the need for an additional matching circuit.

Although the first conductor layer of the first embodiment is formed into a flat square, it is not limited thereto. A structure having any given number of edges in which a given number of slits are disposed is also effective in impedance matching of the antenna unit.

Second Exemplary Embodiment

Figure 5A:
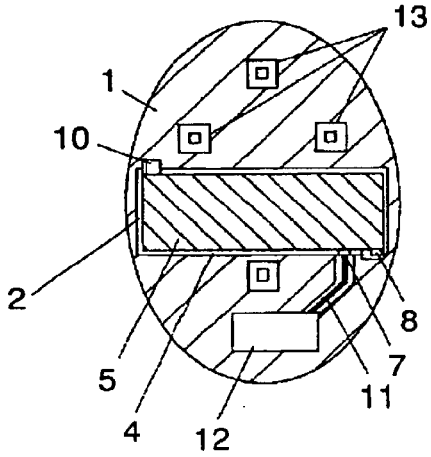
FIG. 5A is a top view of the antenna unit of a second embodiment.
Figure 5B:
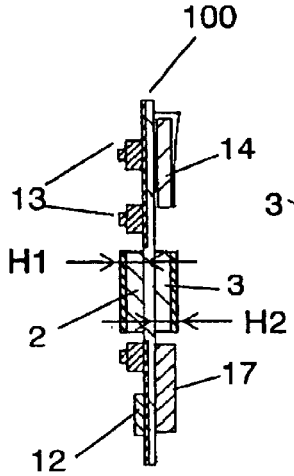
FIG. 5B is a sectional view of the antenna unit of the second embodiment.
Figure 5C:
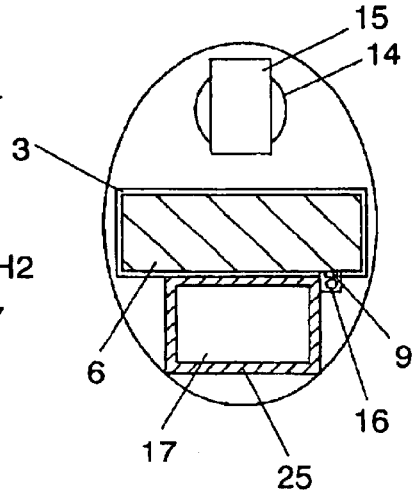
FIG. 5C is a bottom view of the antenna unit of the second embodiment.

The second embodiment of the present invention is described with reference to FIG. 5. FIG. 5A shows a top view (i.e., the first surface) of the antenna unit; FIG. 5B shows a sectional view of the unit; and FIG. 5C shows a bottom view (i.e., the second surface) of the unit. Reference marks "H1 "and "H2" indicate the thickness of second substrate 2 and third substrate 3, respectively. Mechanical switches 13 and first radio-frequency circuit 12 are disposed in an area other than opening 4 on the top surface of ground layer 1. First radio-frequency circuit 12 connects to first feeder section 7 through feeder line 11.

On the other hand, in the area—other than opening 4—on the bottom surface of ground layer 1, battery 14, battery-fixing jig 15, and second radio-frequency circuit 17 are disposed. Second radio-frequency circuit 17 is disposed on second ground layer 25 that is attached to the rear surface of first substrate 1. First radio-frequency circuit 12 and second radio-frequency circuit 17 are connected via a conductive through-hole (not shown) that runs through first substrate 1.

As shown in FIG. 5B, arranging components with a length less than aforementioned H1 and H2, which indicate the thickness of second substrate 2 and third substrate 3, respectively, allows the required project area for the antenna unit to reduce to almost one-half. It is therefore possible to provide an antenna unit with lower profile but still higher gain.

Third Exemplary Embodiment

Figure 6:
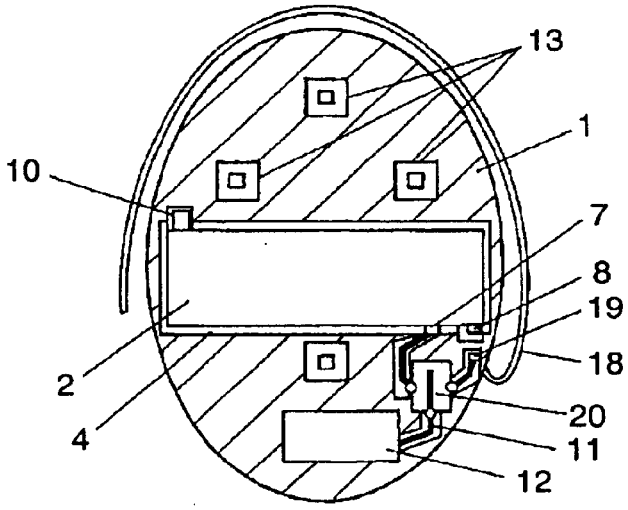
FIG. 6 is a top view of the antenna unit of a third embodiment.

The third embodiment will be described with reference to FIG. 6. In FIG. 6, generally linear conductor element 18 is disposed so as to generally surround the circumference of ground layer 1. One end of element 18 is connected to antenna selector switch 20 via second feeder section 19, and first feeder section 7 is also connected to antenna selector switch 20. This antenna unit is switch-selectable according to environmental conditions.

Figure 7A:
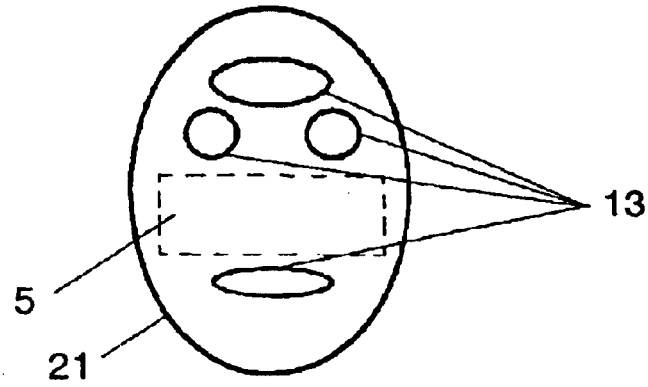
FIG. 7A is an external view of communication equipment equipped with the antenna unit of the third embodiment.
Figure 7B:
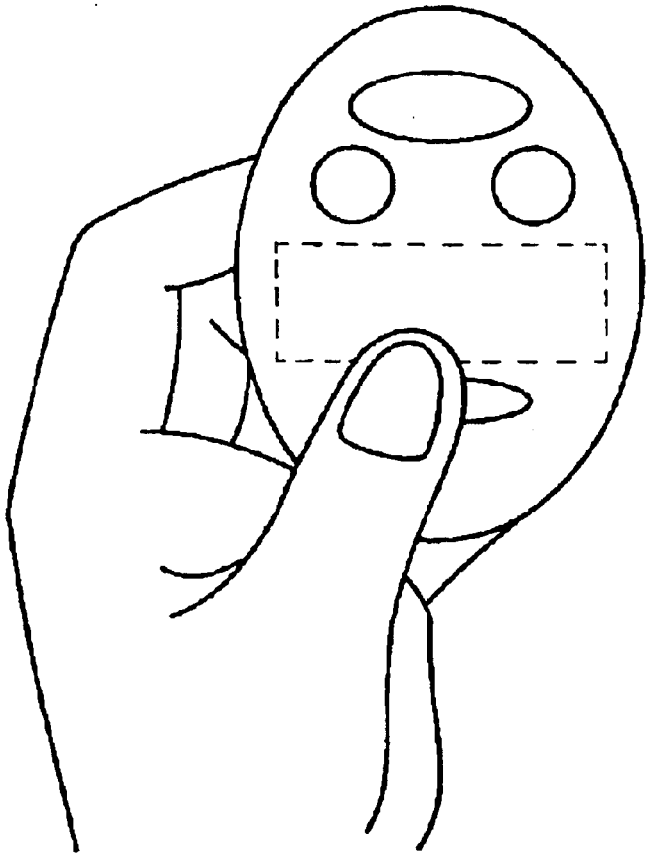
FIG. 7B shows the state in which an operator uses the communication equipment having the antenna unit therein of the third embodiment.

FIG. 7A is an external view of communication equipment equipped with the antenna unit of the present invention. Mechanical switches are disposed on the ground section of first substrate 100. The outside of the communication equipment is covered with an insulating cover 21 made of resin on areas other than those corresponding to the mechanical switches. Cover 21 is perforated with holes at areas having mechanical switches 13, so that an operator can operate the switches from outside. FIG. 7B shows the state in which an operator operates the equipment by fingers.

Figure 8A:
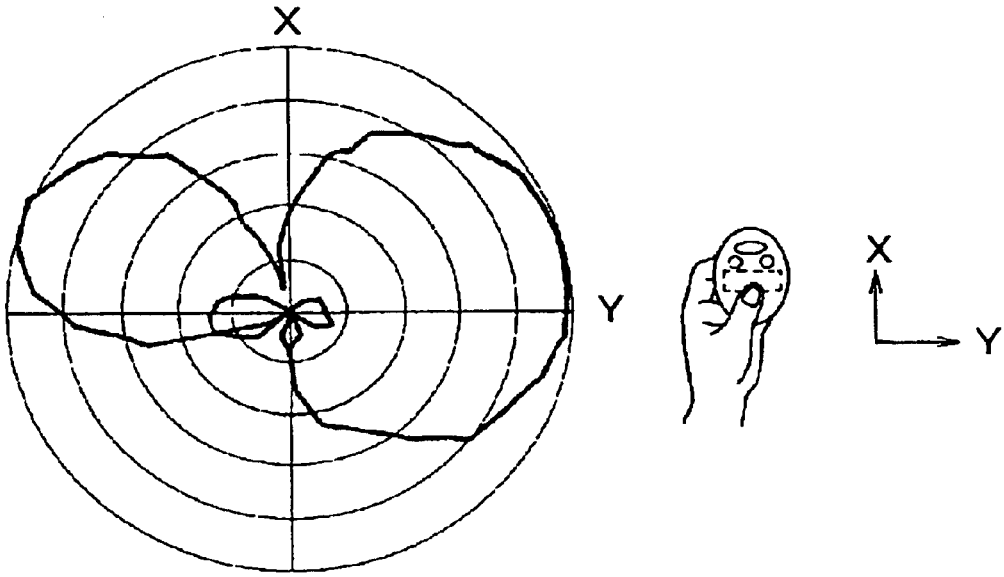
FIG. 8A shows a radiation pattern when a first conductor layer serves as an antenna in the antenna unit of the third embodiment.
Figure 8B:
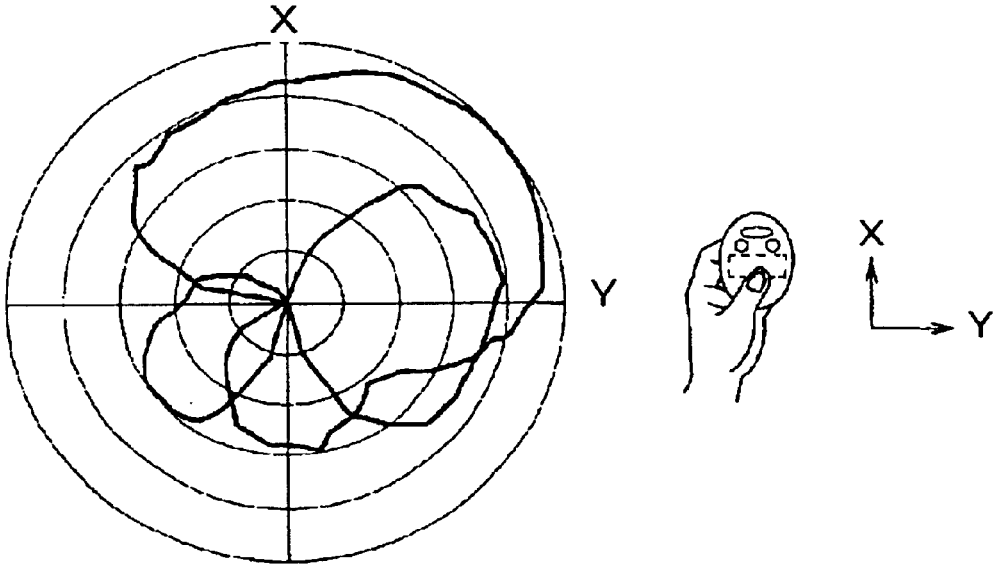
FIG. 8B shows a radiation pattern when a generally linear conductor element serves as an antenna in the antenna unit of the third embodiment.
Figure 9:
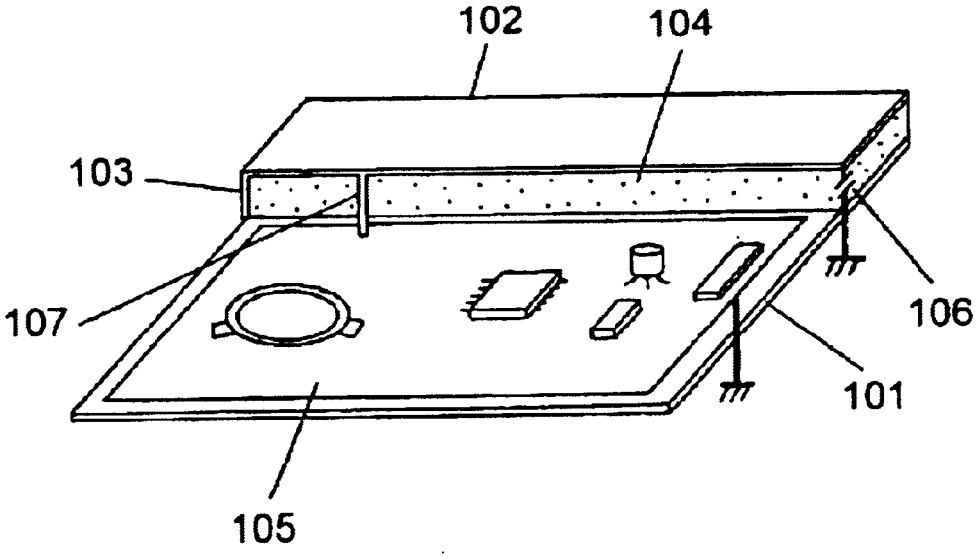
PRIOR ART FIG. 9
FIG. 9 shows a schematic view of a conventional antenna unit.

FIG. 8A shows a radiation pattern when first conductor layer 5 shown in FIG. 7B serves as an antenna in the antenna unit of the third embodiment. When an operator pushes a mechanical switch by a finger to activate the equipment, a null point of the radiation pattern appears in a direction of X-axis—a direction in the front of the operator. If the operator has a communicating partner in the direction of the x-axis, communication quality can be significantly degraded. However, in the communication equipment shown in FIG. 7B, the operator can switch the operating state so that generally linear conductor element 18 alone works as the antenna, thereby increasing the antenna gain along the X-axis (in a direction in front of the operator). FIG. 8B shows a radiation pattern when generally linear conductor element 18 alone serves as the antenna. As is apparent from the figure, a sufficient amount of the antenna gain along the X-axis can be obtained by switching the antenna with the antenna selector switch.

As described above, employing the generally lineal conductor element for the antenna can increase the poor radiant gain obtained by the first conductor layer serving as the antenna. Therefore, communication devices equipped with this antenna can achieve communication with high quality, regardless of how the equipment is oriented.

Furthermore, the structure of the present invention allows the antenna to be switched between the generally linear conductor element and the first conductor layer. The conductor element can offer a desirable radiation pattern with finger-operation of the mechanical switch, while the first conductor layer can offer excellent antenna characteristics in the cases in which the equipment is being put in the operator's chest pocket, or the equipment is kept close to a cigarette case. Such an antenna-selectable function can contribute to an antenna unit with consistent communication quality in various operating environments without serious degradation in performance.

INDUSTRIAL APPLICABILITY

According to the present invention, as described above, the antenna unit, which is built-in mobile devices including identification (ID) card and a pager, not only achieves desirable characteristics with higher gain and broader range, but also offers easy and quick impedance-matching. In addition, the structure has less deformation in its shape due to aging, thereby providing a long-term durability with high quality.

What is claimed is:

1. An antenna unit comprising:

an insulating substrate having a first surface and a second surface opposite said first surface;

a conductive ground layer with an opening having a predetermined shape, said ground layer being disposed on the said first surface of the said first substrate;

a first conductor layer having a shape substantially identical to said predetermined shape of said opening, said first conductor layer being spaced opposite said first surface at the said opening;

a second conductor layer having a shape substantially identical to said predetermined shape of said opening, said second conductor layer being spaced opposite said second surface at a rear surface of said opening;

a feeder section made of a strip-shaped conductor material, and connected to said first conductor layer;

a first short-circuit section made of a strip-shaped conductor material, and connected to said first conductor layer and said ground layer;

a second short-circuit section made of a strip-shaped conductor material, and connected to said second conductor layer and said ground layer; and a capacitor connected to said first conductor layer and said ground layer, wherein, said first conductor layer forms a first antenna.

2. The antenna unit of claim 1, wherein said insulating substrate comprises a first substrate, further comprising a second substrate made of insulating resin, and a third substrate made of insulating resin, said first conductor layer being disposed on said second substrate, said second conductor layer being disposed on said third substrate, said feeder section and said first short-circuit section being disposed along an outer side surface of said second substrate, said second short-circuit section being disposed along an outer side surface of said third substrate, and said second substrate and said third substrate being fixed to said first substrate.

3. The antenna unit of claim 1, wherein said insulating substrate comprises a first substrate, further comprising a second substrate made of insulating resin, said first conductor layer being disposed on said second substrate, said capacitor being disposed at any one of:

i) a position on said first conductor layer spaced farthest from said feeder section; and ii) a position on said second substrate adjacent to said position on said first conductor layer spaced farthest from said feeder section.

4. The antenna unit of claim 1, wherein said feeder section is adjacent to said first short-circuit section.

5. The antenna unit of claim 1, wherein said feeder section is disposed at any one of:

i) a position of said second short-circuit section; and ii) a position adjacent to said second short-circuit section.

6. The antenna unit of claim 1, wherein said first short-circuit section is located at a different position than said second short-circuit section.

7. The antenna unit of claim 1, wherein said opening is shaped as a quadrilateral, said capacitor and said feeder section being disposed so as to have generally diagonally-opposed positions on said quadrilateral-shaped opening.

8. The antenna unit of claim 1, wherein said substrate has a via formed of a short-circuit through-hole filled with conductive material, said ground layer and said second short-circuit section being connected by said via.

9. The antenna unit of claim 1, further comprising a first radio frequency circuit connected to said first feeder section and disposed on said first surface at a position other than a position of said opening.

10. The antenna unit of claim 9, wherein said ground layer comprises a first ground layer, further comprising a second ground layer and a second radio frequency circuit mounted on said second ground layer, said second ground layer being disposed on said second surface at a position other than a position of a rear surface of said opening, said first radio frequency circuit and said second radio frequency circuit being connected by a conductive via.

11. The antenna unit of claim 9, wherein said feeder section comprises a first feeder section, further comprising a substantially linear conductor element; and further comprising a second feeder section disposed on said first surface at a position other than a position of said opening, said substantially linear conductor element and said first radio frequency circuit being connected at said second feeder section.

12. The antenna unit of claim 11, wherein said substantially linear conductor element forms a second antenna.

13. The antenna unit of claim 12, further comprising a selector switch on said first surface at a position other than a position of said opening, and wherein said selector switch is connected to said second feeder section, said first feeder section, and said first radio frequency circuit.

14. The antenna unit of claim 13, wherein said selector switch is operable to switch between said first antenna and said second antenna.

15. The antenna unit of claim 1, further comprising a mechanical switch disposed on said first surface of said substrate at a position other than a position of said opening.

16. A method of manufacturing an antenna unit, comprising:

providing an insulating substrate having a first surface and a second surface opposite the first surface;

forming a conductive ground layer on the first surface of the substrate, the ground layer having an opening with a predetermined shape;

forming a first conductor layer spaced opposite to the first surface at the opening, the first conductor layer having a shape substantially identical to the predetermined shape of the opening;

forming a second conductor layer spaced opposite to the second surface at a rear surface of the opening, the second conductor layer having a shape substantially identical to the predetermined shape of the opening;

forming a feeder section of a strip-shaped conductor material so that the feeder section is connected to the first conductor layer;

forming a first short-circuit section of a strip-shaped conductor material so that the first short-circuit section is connected to the first conductor layer and the ground layer;

forming a second short-circuit section of a strip-shaped conductor material so that the second short-circuit section is connected to the second conductor layer and the ground layer;

forming a capacitor connected to the first conductor layer and the ground layer, and the adjusting the feeder section, the first short-circuit section, and the second short-circuit section for optimized arrangement.

17. The manufacturing method of claim 16, wherein the substrate comprises a first substrate, further comprising:

forming a second substrate of insulating resin, said forming of the first conductor layer including forming the first conductor layer on the second substrate;

forming a third substrate of insulating resin, said forming of the second conductor layer including forming the second conductor layer on the third substrate;

forming the feeder section and the first short-circuit section of conductive material; on a side surface of the second substrate having the first conductor layer;

forming the second short-circuit section of conductive material on a side surface of the third substrate having the second conductor layer; and attaching the second substrate and the third substrate to the first substrate.

18. The manufacturing method of claim 17, wherein said adjusting includes selecting one of a plurality of third substrates having different antenna characteristics, each of the plurality of third substrates having a differently-positioned second short-circuit section.

19. The manufacturing method of claim 17, wherein said adjusting includes selecting one of a plurality of second substrates having different antenna characteristics, each of the plurality of second substrates having a different interval between the first short-circuit section and the feeder section.

* * * * *